US012370431B2

(12) United States Patent
Tryner et al.

(10) Patent No.: US 12,370,431 B2
(45) **Date of Patent: *Jul. 29, 2025**

(54) SPORTS HELMET WITH ADJUSTABLE CHIN STRAP SYSTEM

(71) Applicant: Riddell, Inc., Des Plaines, IL (US)

(72) Inventors: Andrew Tryner, Des Plaines, IL (US); Vittorio Bologna, Des Plaines, IL (US)

(73) Assignee: Riddell, Inc., Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/329,629

(22) Filed: Jun. 6, 2023

(65) Prior Publication Data

US 2023/0310967 A1 Oct. 5, 2023

Related U.S. Application Data

(63) Continuation of application No. 17/741,523, filed on May 11, 2022, now Pat. No. 11,691,067, which is a (Continued)

(51) Int. Cl.
*A63B 71/08* (2006.01)
*A42B 3/08* (2006.01)
(Continued)

(52) U.S. Cl.
CPC ..... *A63B 71/10* (2013.01); *A42B 3/08* (2013.01); *A42B 3/205* (2013.01); *A42B 3/328* (2013.01)

(58) Field of Classification Search
CPC .... A42B 3/08; A42B 3/20; A42B 3/16; A42B 3/00; A42B 3/125; A42B 3/18;
(Continued)

(56) References Cited

U.S. PATENT DOCUMENTS 1,060,220 A 4/1913 White
1,262,818 A 4/1918 McGill
(Continued)

FOREIGN PATENT DOCUMENTS

GB 1354719 6/1974

OTHER PUBLICATIONS

Athletic Journal Catalog Excerpt, vol. 41, No. 10, Jun. 1961 (2 pages).

(Continued)

*Primary Examiner* — Robert H Muromoto, Jr.
(74) *Attorney, Agent, or Firm* — Barnes & Thornburg LLP

(57) ABSTRACT

A protective sports helmet that includes a chin strap system that allows for rapid, one-handed adjustment of a chin strap assembly by the player while he/she is wearing the helmet is provided. The chin strap assembly includes a protective chin cup and a pair of straps extending from opposed sides of the chin cup and having a plurality of securing elements. The assembly also includes a pair of adjustable connectors affixed to the helmet and that include a central opening that receives an extent of the strap and a lever that engages a portion of the securing elements. The adjustable connector allows movement of the strap in a first direction, and prevents movement of the strap in a second direction when the lever is engaged with at least one of the securing elements. The adjustable connector allows movement of the strap in both the first and second directions when the lever is not engaged with the securing elements.

20 Claims, 8 Drawing Sheets

Related U.S. Application Data continuation of application No. 17/164,667, filed on Feb. 1, 2021, now Pat. No. 11,331,558, which is a continuation of application No. 16/247,307, filed on Jan. 14, 2019, now Pat. No. 10,905,936, which is a continuation of application No. 15/482,231, filed on Apr. 7, 2017, now Pat. No. 10,179,271, which is a continuation of application No. 14/451,101, filed on Aug. 4, 2014, now Pat. No. 9,622,532.

(60) Provisional application No. 61/861,536, filed on Aug. 2, 2013.

(51) Int. Cl.

| | |
|---|---|
| ***A42B 3/20*** | (2006.01) |
| ***A42B 3/32*** | (2006.01) |
| ***A63B 71/10*** | (2006.01) |
| *A42B 3/04* | (2006.01) |

(58) Field of Classification Search

CPC ..... A42B 3/145; A42B 1/22; A42B 3/288; A42B 3/205; A42B 3/326; A63B 71/10; A63B 2243/0045; A63B 2243/005; A63B 2243/0041; A63B 2243/0066; A63B 2243/007; A63B 33/002; A62B 18/084; A41F 1/008; A41F 9/002; A44B 11/20; A44B 11/2592; A44B 11/24; A44B 11/26; A44B 11/266; A44B 11/06; A44B 11/12; A44B 11/14; A43C 11/148; A43C 11/1486; A43C 11/1413; A43C 11/146; A44C 5/2042

See application file for complete search history.

(56) References Cited

U.S. PATENT DOCUMENTS

| | | | | | |
|---|---|---|---|---|---|
| 2,140,716 | A | | 12/1938 | Pryale | |
| 2,250,275 | A | | 7/1941 | Riddell | |
| 2,354,840 | A | | 8/1944 | Seletz | |
| 2,777,127 | A | | 1/1957 | Marietta | |
| 2,867,811 | A | * | 1/1959 | Jones | A42B 3/08 2/9 |
| 2,867,812 | A | * | 1/1959 | Roth | A62B 18/084 2/9 |
| 3,106,716 | A | | 10/1963 | Beebe | |
| 3,113,362 | A | * | 12/1963 | Petruzziello | A44C 5/2042 24/644 |
| 3,166,761 | A | | 1/1965 | Strohm | |
| 3,186,004 | A | | 6/1965 | Carlini | |
| 3,187,342 | A | | 6/1965 | Aileo | |
| 3,189,917 | A | | 6/1965 | Sims | |
| 3,216,023 | A | | 11/1965 | Morgan | |
| 3,267,545 | A | * | 8/1966 | Eckart | A43C 11/148 24/DIG. 48 |
| 3,274,613 | A | | 9/1966 | Sowle | |
| 3,327,316 | A | | 6/1967 | Pukish | |
| 3,418,657 | A | | 12/1968 | Lastnik | |
| 3,423,832 | A | * | 1/1969 | Nelson | A61C 7/06 433/5 |
| 3,462,763 | A | | 8/1969 | Schneider | |
| 3,478,365 | A | | 11/1969 | Varga | |
| 3,619,813 | A | | 11/1971 | Marchello | |
| 3,729,744 | A | | 5/1973 | Rappleyea | |
| 3,761,959 | A | | 10/1973 | Dunning | |
| 3,787,895 | A | | 1/1974 | Belvedere | |
| 3,815,152 | A | | 6/1974 | Bednarczuk | |
| 3,818,508 | A | | 6/1974 | Lammers | |
| 3,916,446 | A | * | 11/1975 | Gooding | A42B 3/08 2/421 |
| 3,994,020 | A | | 11/1976 | Villari | |
| 4,044,400 | A | | 8/1977 | Lewicki | |
| 4,075,714 | A | | 2/1978 | Ryder | |
| 4,398,306 | A | | 8/1983 | Gooding | |
| 4,461,044 | A | | 7/1984 | Reiterman | |
| 4,577,375 | A | * | 3/1986 | Beaussant | F16B 21/16 24/DIG. 45 |
| 4,641,382 | A | * | 2/1987 | Gessalin | A42B 3/326 2/421 |
| 4,646,368 | A | * | 3/1987 | Infusino | A42B 3/08 2/421 |
| 4,646,401 | A | * | 3/1987 | Morell | A63C 9/04 24/593.11 |
| 4,651,356 | A | | 3/1987 | Zide | |
| 4,665,748 | A | | 5/1987 | Peters | |
| 4,692,947 | A | | 9/1987 | Black | |
| 4,727,630 | A | * | 3/1988 | Alan | A44B 11/06 24/593.11 |
| 4,733,440 | A | | 3/1988 | Ogawa | |
| D295,800 | S | | 5/1988 | Shelton, Jr. | |
| 4,741,054 | A | | 5/1988 | Mattes | |
| 4,853,980 | A | | 8/1989 | Zarotti | |
| 4,903,381 | A | * | 2/1990 | Fohl | A44B 11/26 24/DIG. 43 |
| 4,999,846 | A | * | 3/1991 | Ball | A42B 1/22 2/418 |
| 5,101,580 | A | | 4/1992 | Lyden | |
| D332,507 | S | | 1/1993 | Anderson | |
| 5,177,816 | A | | 1/1993 | Schmidt | |
| 5,184,352 | A | * | 2/1993 | Maufette | B65D 63/1072 24/616 |
| 5,267,679 | A | | 12/1993 | Kamaya | |
| 5,347,660 | A | | 9/1994 | Zide | |
| 5,461,730 | A | | 10/1995 | Carrington | |
| 5,483,699 | A | | 1/1996 | Pernicka | |
| 5,572,771 | A | | 11/1996 | Kelleghan | |
| 5,579,563 | A | * | 12/1996 | Sim | A44B 11/2592 24/615 |
| 5,588,186 | A | | 12/1996 | Ko | |
| D378,236 | S | | 2/1997 | Zanotto | |
| 5,688,229 | A | * | 11/1997 | Bauer | A61F 5/055 602/5 |
| 5,732,414 | A | | 3/1998 | Monica | |
| 5,774,953 | A | * | 7/1998 | Mao | A45C 13/30 24/191 |
| 5,794,274 | A | | 8/1998 | Kraemer | |
| 5,799,337 | A | * | 9/1998 | Brown | A42B 3/08 2/424 |
| 5,913,412 | A | | 6/1999 | Huber | |
| 5,946,735 | A | * | 9/1999 | Bayes | A42B 3/08 24/442 |
| 6,081,932 | A | * | 7/2000 | Kraemer | A42B 3/08 2/421 |
| 6,189,156 | B1 | | 2/2001 | Loiars | |
| 6,256,798 | B1 | | 7/2001 | Egolf | |
| 6,298,483 | B1 | | 10/2001 | Schiebl | |
| 6,324,701 | B1 | * | 12/2001 | Alexander | A42B 3/08 2/421 |
| 6,341,382 | B1 | * | 1/2002 | Ryvin | A42B 3/145 2/418 |
| 6,457,210 | B1 | * | 10/2002 | Shirai | A44B 11/2592 24/16 PB |
| 6,481,024 | B1 | | 11/2002 | Grant | |
| 6,499,139 | B1 | | 12/2002 | Brown | |
| 6,499,147 | B2 | | 12/2002 | Schiebl | |
| 6,568,505 | B1 | | 5/2003 | Dacquisto | |
| 6,691,378 | B1 | * | 2/2004 | Chou | A63B 33/004 248/231.51 |
| 6,715,449 | B1 | * | 4/2004 | Jordan | A01K 27/005 24/DIG. 48 |
| 6,772,447 | B2 | | 8/2004 | Morrow | |
| 6,934,971 | B2 | | 8/2005 | Ide | |
| D512,534 | S | | 12/2005 | Maddux | |
| D526,746 | S | | 8/2006 | Wong | |
| 7,162,778 | B2 | * | 1/2007 | Pan | A63B 33/002 24/593.11 |
| 7,240,376 | B2 | * | 7/2007 | Ide | A42B 3/122 2/425 |
| 7,246,383 | B2 | * | 7/2007 | Musal | A44B 11/20 2/418 |

(56) References Cited

U.S. PATENT DOCUMENTS

| | | | | |
|---|---|---|---|---|
| 7,296,305 | B2 | 11/2007 | Ketterer | |
| 7,735,160 | B1 | 6/2010 | Schiebl | |
| 7,870,617 | B2 | 1/2011 | Butler | |
| 7,886,370 | B2 | 2/2011 | Winningham | |
| 7,900,279 | B2 * | 3/2011 | Kraemer | A42B 3/205 2/421 |
| 7,921,475 | B2 | 4/2011 | Nascimento | |
| 7,954,177 | B2 * | 6/2011 | Ide | A42B 3/20 |
| 8,006,322 | B1 | 8/2011 | Schiebl | |
| 8,056,151 | B2 * | 11/2011 | Bologna | A42B 3/08 24/324 |
| 8,453,269 | B2 | 6/2013 | Hampton, II | |
| 8,528,118 | B2 * | 9/2013 | Ide | A42B 3/08 2/425 |
| D695,468 | S | 12/2013 | Finlan | |
| 8,621,671 | B1 | 1/2014 | Schiebl | |
| 8,650,665 | B2 * | 2/2014 | Shirai | A41F 1/008 2/183 |
| D715,005 | S | 10/2014 | Schiebl | |
| 8,938,818 | B2 * | 1/2015 | Ide | A42B 3/12 2/425 |
| 8,955,200 | B2 | 2/2015 | Ng | |
| 9,068,674 | B1 | 6/2015 | Mangone | |
| 9,144,270 | B2 | 9/2015 | Mitchell, Jr. | |
| 9,314,060 | B2 | 4/2016 | Giles | |
| 9,622,532 | B2 * | 4/2017 | Tryner | A63B 71/10 |
| 9,681,695 | B2 | 6/2017 | Beauchamp | |
| 9,756,889 | B2 | 9/2017 | Infusino | |
| 9,763,488 | B2 | 9/2017 | Bologna | |
| 9,788,591 | B2 | 10/2017 | Ide | |
| 9,867,415 | B2 | 1/2018 | Gowen | |
| 10,136,692 | B2 | 11/2018 | Ide | |
| 10,179,271 | B2 * | 1/2019 | Tryner | A63B 71/10 |
| 10,905,936 | B2 * | 2/2021 | Tryner | A42B 3/328 |
| 11,331,558 | B2 * | 5/2022 | Tryner | A42B 3/328 |
| 11,691,067 | B2 * | 7/2023 | Tryner | A42B 3/328 2/421 |
| 2002/0104533 | A1 | 8/2002 | Kalhok | |
| 2004/0098793 | A1 * | 5/2004 | Gershenson | A42B 3/08 2/421 |
| 2005/0273911 | A1 * | 12/2005 | Skiba | A42B 3/063 2/412 |
| 2006/0117466 | A1 * | 6/2006 | Abelman | A42B 3/08 2/421 |
| 2006/0150304 | A1 * | 7/2006 | Bentz | A42B 3/08 2/421 |
| 2008/0028500 | A1 * | 2/2008 | Bentz | A42B 3/08 2/9 |
| 2008/0092277 | A1 * | 4/2008 | Kraemer | A42B 3/205 24/458 |
| 2009/0038055 | A1 | 2/2009 | Ferrara | |
| 2009/0265841 | A1 | 10/2009 | Ferrara | |
| 2010/0192286 | A1 * | 8/2010 | Bologna | A44B 11/04 2/421 |
| 2010/0319109 | A1 * | 12/2010 | Field | A42B 3/08 2/421 |
| 2010/0319701 | A1 * | 12/2010 | Connell | A62B 18/084 128/207.11 |
| 2011/0209272 | A1 | 9/2011 | Drake | |
| 2011/0225706 | A1 | 9/2011 | Pye | |
| 2011/0271428 | A1 * | 11/2011 | Withnall | A42B 3/20 2/422 |
| 2011/0277221 | A1 * | 11/2011 | Ide | A42B 3/12 2/421 |
| 2012/0124721 | A1 * | 5/2012 | Hampton, II | A42B 3/08 2/425 |
| 2013/0074248 | A1 | 3/2013 | Evans | |
| 2014/0068844 | A1 * | 3/2014 | Infusino | A42B 3/08 2/421 |
| 2014/0150168 | A1 | 6/2014 | Erb | |
| 2014/0150169 | A1 * | 6/2014 | Ide | A42B 3/20 2/421 |
| 2015/0013122 | A1 | 1/2015 | Mitchell, Jr. | |
| 2018/0084859 | A1 | 3/2018 | Bancroft | |

OTHER PUBLICATIONS

Athletic Journal Catalog Excerpt, vol. 37, No. 5, Jan. 1957 (2 pages).
Athletic Journal Catalog Excerpt, vol. 41, No. 9, May 1961 (2 pages).
Athletic Journal Catalog Excerpt, vol. 48, No. 3, Nov. 1967 (2 pages).
Rawlings 1955-56 Advance Football and Basketball Catalog (36 pages).
Rawlings Advance Football and Basketball Catalog 1957 (46 pages).
Rawlings Catalog Fall and Winter Athletic Equipment 1959-1960 (84 pages).
Rawlings Catalog Fall and Winter Athletic Equipment 1963 (72 pages).
Rawlings Catalog Fall and Winter Institutional 1971 (92 pages).
Rawlings Catalog Fall and Winter Retail Sher-wood Adirondack 1975 (28 pages).
Riddell 1989 Football Air Catalog (16 pages).
Riddell 1989 Football Catalog (24 pages).
Riddell 1992 Catalog (40 pages).
Riddell 1996-1997 Football Catalog (40 pages).
Riddell 1998 Football Air Catalog (16 pages).
Riddell 1998-1999 Football Catalog (72 pages).
Riddell 2001 Football Catalog (94 pages).
Wilson Trade Price Edition Fall and Winter 1964 Catalog (152 pages).
Schutt 2001 Football Catalog (46 pages).
Medalist Gladiator 1989 Fall and Winter Catalog (20 pages).
Scholastic Coach, MacGregor E700 Helmet, Jan. 1959 (2 pages).
Sports Review Football 1954, Rawlings HC20 and TH24 Helmet (2 page).
Sears Wish Book for the 1971 Christmas Season Catalog (11 pages).
GB Lax Gait Brothers Lacrosse Magazine 2002 (24 pages).
Sears Fall and Winter Catalog 1966 (2 pages).
Hutch Catalog 1976 (40 pages).
Bike Football Catalog 2002 (2 pages).
David Bushing, Sports Equipment Price Guide (1995), pp. 236-238, 240-241, 243-244, 263.
Riddell 2004 Football Catalog (88 pages).
Riddell 2005 Catalog (164 pages).
Riddell 2009 Football Catalog (132 pages).
Schutt 2009 Football Quick Guide (12 pages).
"Rail." Merriam-Webster.com. Accessed May 5, 2016. http://www.merriam-webster.com/dictionary/rail.
Riddell 2008, Multi-Sport catalog, including cover page and football chin straps (p. 14).
Scholastic Coach, Spalding Helmet, Mar. 1959 (2 pages).
John Field, Patton of the Armored Force, Life Magazine, Nov. 30, 1942 (4 pages).
Athletic Journal Catalog Excerpt, vol. 47, No. 3, Nov. 1966 (2 pages).
Athletic Journal Catalog Excerpt, MacGregor E700 Helmet, Jan. 1959 (1 page).

* cited by examiner

SPORTS HELMET WITH ADJUSTABLE CHIN STRAP SYSTEM

CROSS-REFERENCE TO RELATED APPLICATIONS

This application is a continuation of U.S. patent application Ser. No. 17/741,523, which is a continuation of U.S. Pat. No. 11,331,558, which is a continuation of U.S. Pat. No. 10,905,936, which is a continuation of U.S. Pat. No. 10,179,271, which is a continuation of U.S. Pat. No. 9,622,532, which claims the benefit of Provisional Patent Application No. 61/861,536, all of which are incorporated in their entirety herein by reference and made a part hereof.

TECHNICAL FIELD

The invention relates to a protective helmet, namely for contact sports, having an adjustable chin strap system allowing for rapid, one-handed adjustment of the chin strap assembly while the helmet is being worn by the player.

BACKGROUND OF THE INVENTION

Helmets for contact sports, such as those used in football, hockey and lacrosse, typically include a shell, a faceguard or face mask, and a chin strap assembly that removably secures the helmet on the player or wearer's head. The chin strap assembly is secured to the shell by a plurality of two-piece snap connectors, whereby the chin strap assembly can sustain a number of impacts during the course of play while remaining connected to the shell. With conventional helmets, each two-piece snap connector consists of a post extending outward from the shell and a female snap member that mates with the post. The female snap member is integrated with a buckle that typically includes two slots, wherein a chin strap member is threaded through the slots.

One existing chin strap assembly is disclosed in U.S. Pat. No. 6,934,791, which is owned by Riddell Inc., the assignee of the present application. That chin strap assembly includes a protective chin cup, a strap connected to each side of the chin cup and a buckle on each end portion of the straps. The strap ends are threaded through slots in the buckle and the buckle position may be adjusted on the strap by further threading the strap in one direction or the other through the slots of the buckle. The buckle also includes the female snap member that mates with the male snap post extending from the shell of the helmet.

While such conventional chin strap assemblies provide a number of benefits, they nevertheless have certain limitations. For example, installing and then adjusting the chin strap assembly can be difficult and time-consuming. Because the strap is fed through the buckle, two hands are required to loosen the strap within the slots of the buckle and adjust the straps further in one direction or the other. Adjusting the chin strap assembly becomes even more challenging when the player is wearing the helmet and cannot see the buckle and thus cannot determine proper positioning of the buckle. Adjustment is further comprised when the player is wearing protective gloves or if the player has limited mobility in his fingers (e.g., his fingers are taped). In the event a player needs to make a rapid adjustment, the player may have to enlist the help of another player, coach or a training staff member, which may require the player to return to the sidelines and leave the field of play thereby preventing him from being available for the next play.

The present disclosure is provided to solve these limitations and to provide advantages and aspects not provided by conventional sports helmets. A full discussion of the features and advantages of the present invention is deferred to the following detailed description, which proceeds with reference to the accompanying drawings.

SUMMARY OF THE INVENTION

The present invention is directed to a protective sports helmet that includes an adjustable chin strap system that, through its novel design, allows for rapid, one-handed adjustment of the chin strap assembly by the player while he/she is wearing the helmet. In one embodiment, the adjustable chin strap system includes at least one ratchet connector that receives a chin strap member having a plurality of engagement elements (e.g., a plurality of teeth). The ratchet connector allows movement of the chin strap in one direction but, absent an actuation force, restricts movement of the chin strap in a second, opposite direction. The adjustable chin strap system allows the player to rapidly loosen and/or tighten the chin strap assembly with one hand to ensure proper fit while the helmet is being worn, and further allows the player to loosen the chin strap with just one of his hands to enable removal of the helmet from his head.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
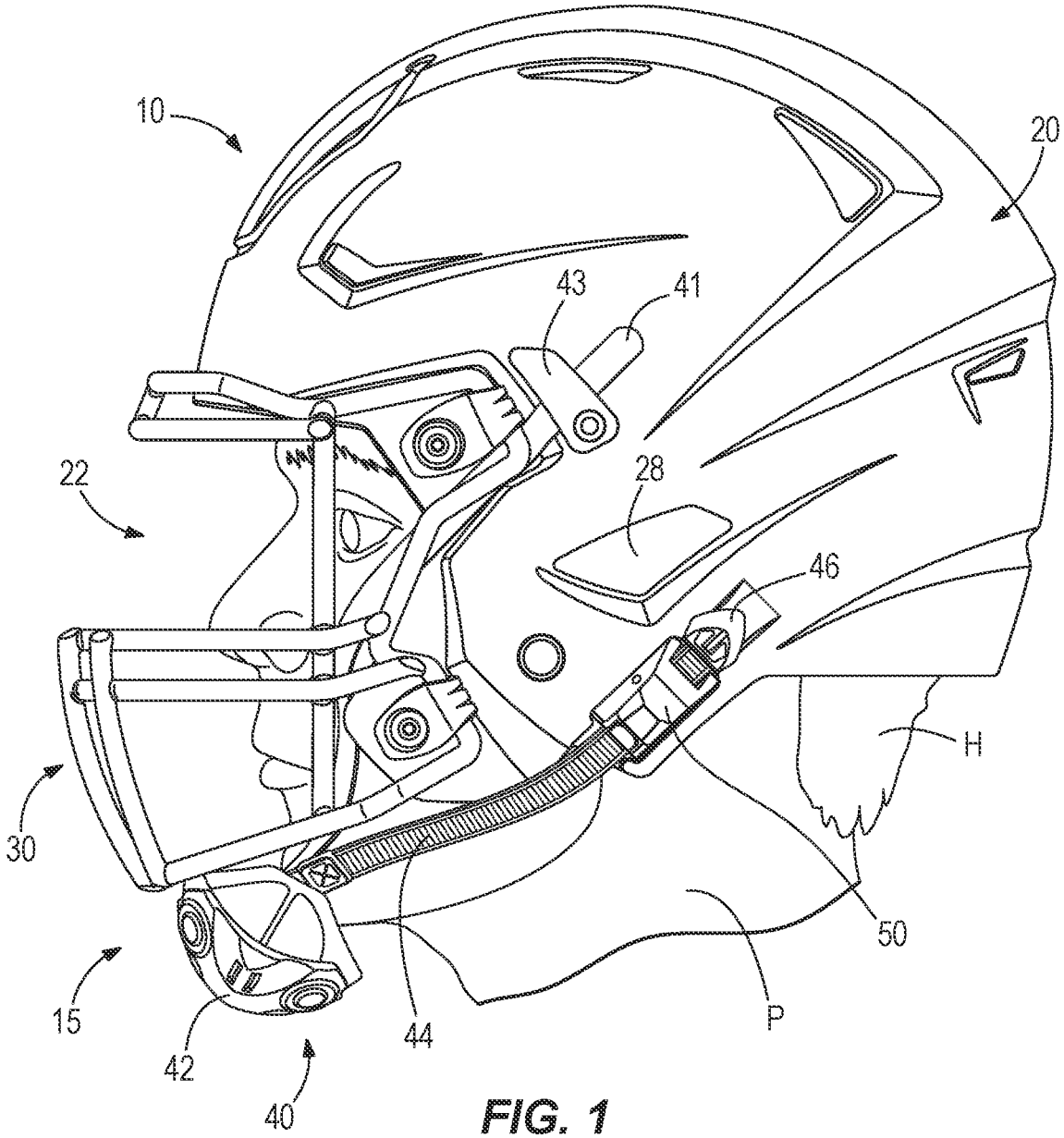
FIG. 1 is a side view of an embodiment of a helmet having an adjustable chin strap system, showing the helmet on a wearer's head and the chin strap in an initial, loose position.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-12 show a protective sports helmet 10, for example a football helmet, including an adjustable chin strap system 15 that allows for rapid, one-handed adjustment of a chin strap assembly 40 by the player P while he/she is wearing the helmet. Rapid, one-handed adjustment of a chin strap assembly 40 is important because it allows the player P to rapidly loosen and/or tighten the chin strap assembly 40 with one hand to ensure proper fit while the helmet 10 is being worn by the player P. Rapid, one-handed adjustment allows the player to tighten the chin strap assembly 40 when the player P puts the helmet 10 on his/her head H. Furthermore, rapid, one-handed adjustment allows the player P to loosen the chin strap assembly 40 with just one of his hands to enable removal of the helmet 10 from his/her head. This rapid, one-handed adjustment, including the loosening of the chin strap assembly 40 and the subsequent removal of the helmet 10 does not require disengagement of the chin strap assembly 40 from the helmet 10. In contrast, conventional helmets require its chin strap assembly to be disengaged from the helmet before the helmet can be removed from the player's head. In addition, the rapid, one-handed adjustment of the chin strap assembly 40 can be done while the helmet 10 remains on the player's head H which is advantageous because a team can be penalized when a player P removes his/her helmet 10 while on the playing field before exiting to the sidelines. It is understood that exiting the playing field to the sidelines is not advantageous because the player P is not available to participate in at least the next play. Although shown as a football helmet, the helmet 10 may be one suitable for use in other contact sports requiring head protection such as hockey or lacrosse. The helmet 10 also includes a protective shell 20, an internal padding assembly 100, and a faceguard 30 that spans a frontal opening 22 of the helmet shell 20.

The adjustable chin strap system 15 includes the chin strap assembly 40 and at least two adjustable connector brackets 50 that are affixed to the helmet 10 wherein each bracket 50 receives an extent of a chin strap member 44, as discussed below. The chin strap assembly 40 includes a protective cup member 42 that engages and overlies the player's chin, a pair of lower strap members 44 and a pair of upper strap members 41. The strap members 41, 44 are operably connected to the chin cup 42 and extend outwardly there from for connection to the helmet 10. As a result, a pair of strap members 41, 44 extend from each side of the chin cup 42. A first lower strap 44 and a first upper strap 41 extend from a first side of the cup 42, and a second lower strap 44 and a second upper strap 41 extend from a second side of the cup 42. Referring to FIGS. 3, 4, 7 and 9, the lower strap 44 includes a mating segment 44*a* that facilitates connection with the chin cup member 42. The chin cup member 42 may be an assembly of an outer protective layer and an inner padding layer. The chin cup member 42 shown in the Figures is disclosed in U.S. patent application Ser. No. 14/021,899, which is owned by Riddell Inc., the assignee of the present application, and which is incorporated in its entirety by reference. The upper and lower strap members 41, 44 can be distinct straps or they can result from a single, continuous strap member affixed to or threaded through the chin cup 42.

In the embodiment shown in the Figures, the adjustable chin strap system 15 is configured as a "four-point hook-up" with four distinct connection points of the strap system 15 to the helmet 10. In this configuration and as described below, adjustment of the chin strap system 15 occurs when the player P engages the lower strap member 44, not the upper strap member 41, and the connector bracket 50. The upper strap member 41 is fixedly secured to the helmet shell 20 by a clamp 43 that does not allow for displacement or rapid adjustment of the upper strap member 41. The clamp 43 is disclosed in U.S. Pat. No. 7,900,279 entitled, "Sports Helmet with Claim for Securing a Chin Protector," which is owned by the assignee of the present application. Alternatively, the adjustable chin strap system 15 may be configured to have a connector 50 for each of the four connection points of the chin strap assembly 40. Thus, the adjustable chin strap system 15 may be configured to have four adjustable connectors 50, each configured to receive and retain an end of a strap member 44. Alternatively, the adjustable chin strap system 15 can be configured as a "two-point hook-up" that eliminates the upper strap members 41 and results in only two connection points with the helmet 10.

Figure 6:
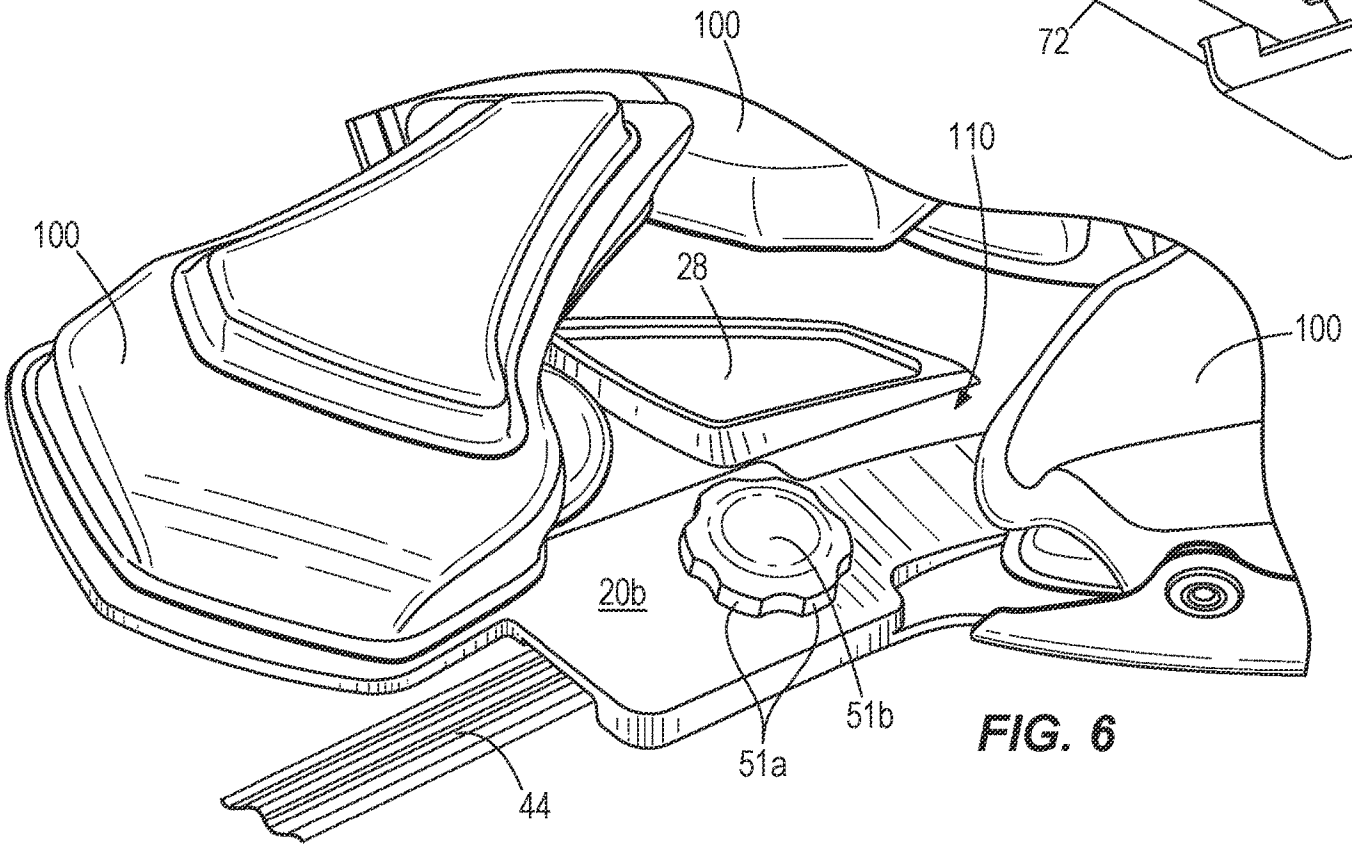
FIG. 6 is a partial internal view of the helmet and adjustable chin strap system, showing the positional relationship of the helmet, the internal padding assembly of the helmet and the chin strap.
Figure 7:
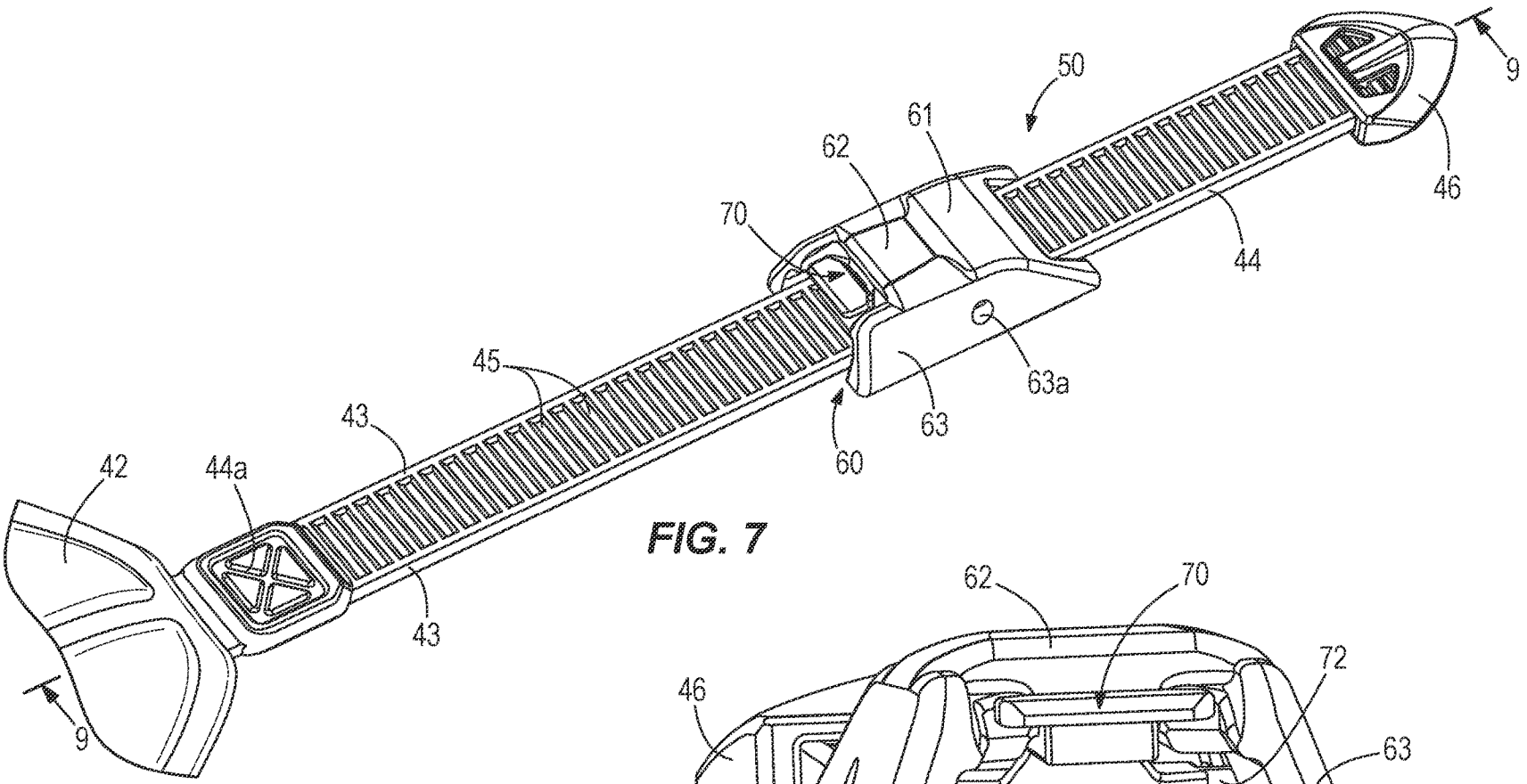
FIG. 7 is a perspective view of the chin strap system.
Figure 8:
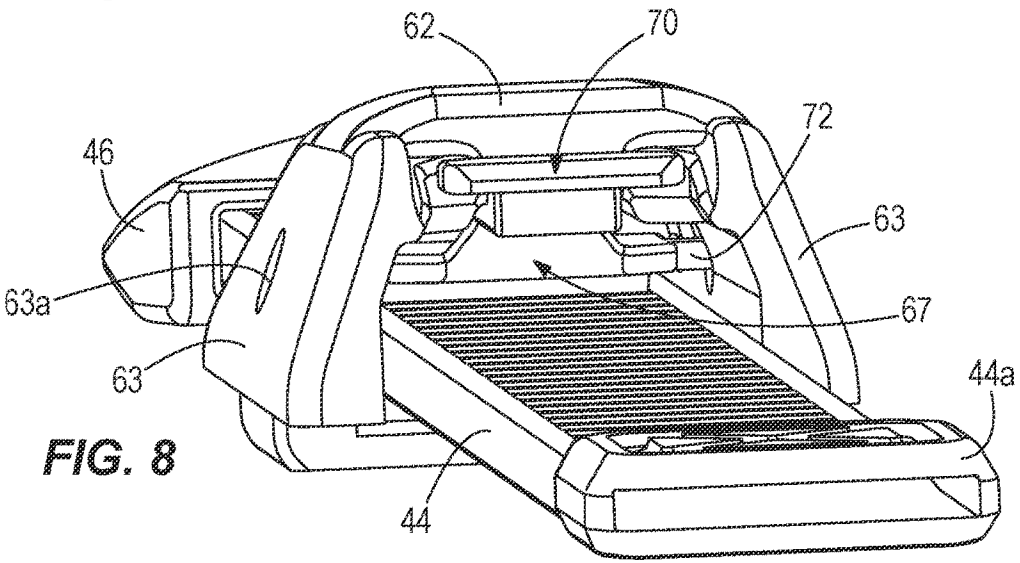
FIG. 8 is a front perspective view of the chin strap system.
Figure 9:
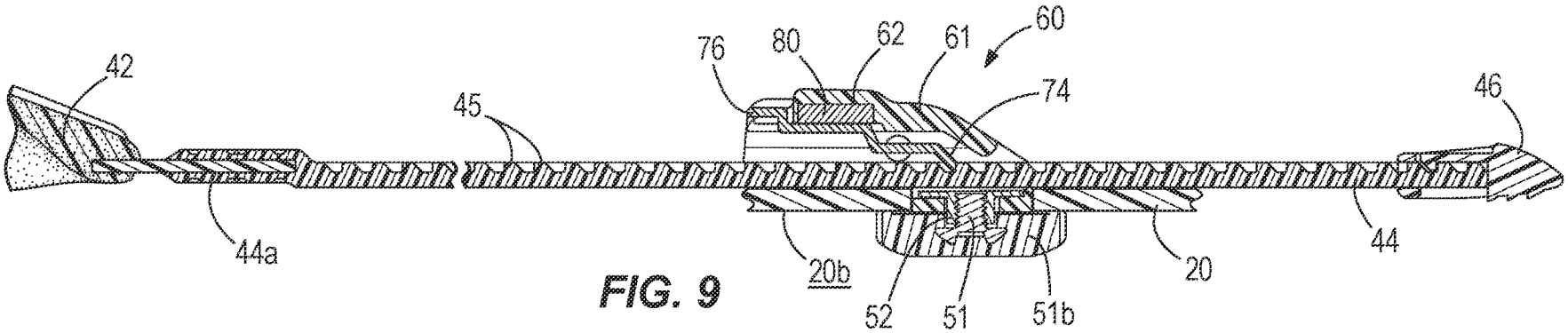
FIG. 9 is a cross-sectional view of the chin strap system taken along line 9-9 of FIG. 7.

Referring to FIGS. 1-6, the adjustable connector 50 is securely or rigidly connected to a receptacle 24 (see FIG. 4) formed in the helmet shell 20 by a fastener 51 wherein the fastener 51 extends through an opening 25 in the shell 20 and into the connector 50. Alternatively, the adjustable chin strap system 15, including the connector 50, can be added or retrofitted to a conventional helmet that lacks the receptacle 24 to replace a conventional chin strap assembly. Preferably, the fastener 51 is configured as a thumb-screw with external means to facilitate actuation of the fastener 51, such as external ridges 51*a* arranged about a central hub 51*b*, by the player P or a member of the coaching staff or training staff. As shown in FIG. 6, the ridges 51*a* and the hub 51*b* are positioned adjacent an internal surface 20*b* of the shell 20. In one embodiment, the receptacle 24 is integrally formed in the helmet shell 20 and includes a channel 26 extending from a front shell edge 20*a* below the jaw flap 27. The channel 26 is recessed and extends rearward from the front shell edge 20*a* below an ear opening 28 and towards a rear portion of the shell 10. Preferably, the opening 25 is positioned within the channel 26. In another embodiment, the adjustable connector 50 is integrally formed with the helmet shell 20, for example during the shell molding process. In an installed position of FIGS. 1-3 and due to the receptacle 24 and the channel 26, the connector 50 has a low-profile arrangement with an outer shell surface 20*c* of the helmet 10, preferably below the ear opening 28. In the embodiment of the Figures, the connector 50 extends less than 0.5 inch from the outer shell surface 20*c*, and preferably no more than 0.4 inch from the outer shell surface 20*c*, and most preferably only 0.35 inch from the outer shell surface 20*c* (see FIG. 3). This low-profile arrangement of the connector 50 and the helmet shell 20 is a function of their cooperative structures and improves the reliability and durability of the system 15 because the low-profile arrangement helps to minimize the impacts received by the connector 50 during play of the contact sport.

Referring to FIGS. 4, 5 and 9-12, the system 15 includes a securing element 52 that receives an extent of the fastener 51 for securement of the connector 50 in the receptacle 24 of the shell 20. In the embodiment shown in the Figures, the securing element 52 is configured as a T-nut with a flange 52*a* and an internally threaded, elongated receiver 52*b* that extends from the flange 52*a* and that receives an extent of the fastener 51. Alternatively, the securing element 52 may be configured as a nut, a snap post and the like. The securing element 52 is coupled to a lower mating portion 64 of the connector 50 wherein the flange 52*a* resides within a cavity 65 formed in the mating portion 64 and the elongated receiver 52*b* extends through an aperture 64*a*. As shown in FIGS. 9-12, the mating portion 64 depends from a main body portion or housing 60 of the connector 50 and resides within the opening 25 of the receptacle 24. In the assembled position shown in FIGS. 9-12, the fastener 51 extends through the shell opening 25 and the mating portion aperture 64*a* and into the securing element 52 for securement of the connector 50 to the helmet shell 20. Referring to FIG. 6, the internal padding assembly 100 is cooperatively positioned with the ear opening 28 to provide an internal interface area 110 of the helmet 10 that accommodates the fastener 51. The fastener 51 can be loosened and disengaged by the training staff, including while the helmet 10 is worn by a player lying on the ground in the supine position. Thus, the connector 50 and the chin strap assembly 40 can be removed to gain access to the player's chin and jaw regions, in the event the player P is injured.

As shown in FIGS. 4-8, the connector housing or main body portion 60 includes a sloped rear wall 61, top wall 62, opposed side walls 63 that are joined with the lower mating portion 64 and a central opening 67 that extends longitudinally through the main body 60. The central opening 67 receives an extent of the strap member 44 and allows for selective lateral movement of the strap 44 in either direction through the main body 60. In the installed position of FIGS. 9-12, the lower mating portion 64 of the main body portion 60 extends through the shell opening 25 such that an end surface 66 of the lower mating portion 64 is substantially flush with the inner surface 20*b* of the shell 20. The channel 26 is configured to receive a second extent of the strap member 44, thereby facilitating lateral movement of the strap 44 within the main body 60 and the connector 50. Thus, the channel 26 and the central opening 67 define a pathway for selective lateral movement of the strap member 44.

Figure 10:
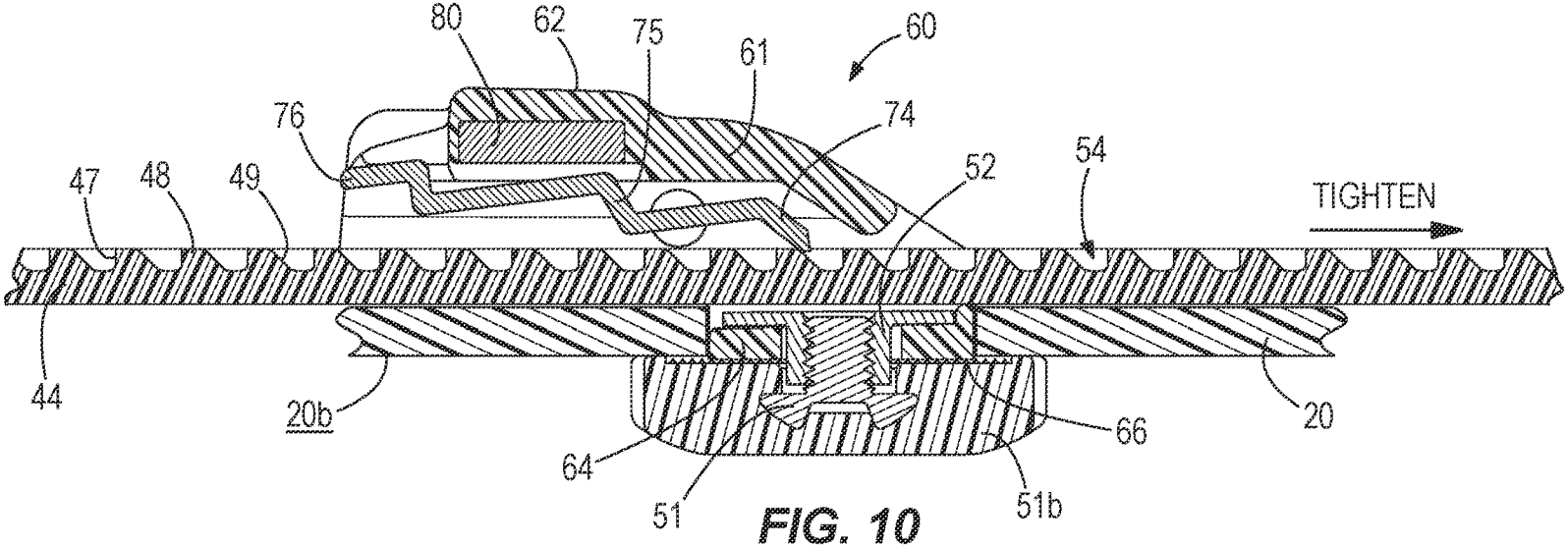
FIG. 10 is a partial cross-sectional view of the chin strap system, showing the system allowing movement of the strap that results in the system being tightened.
Figure 11:
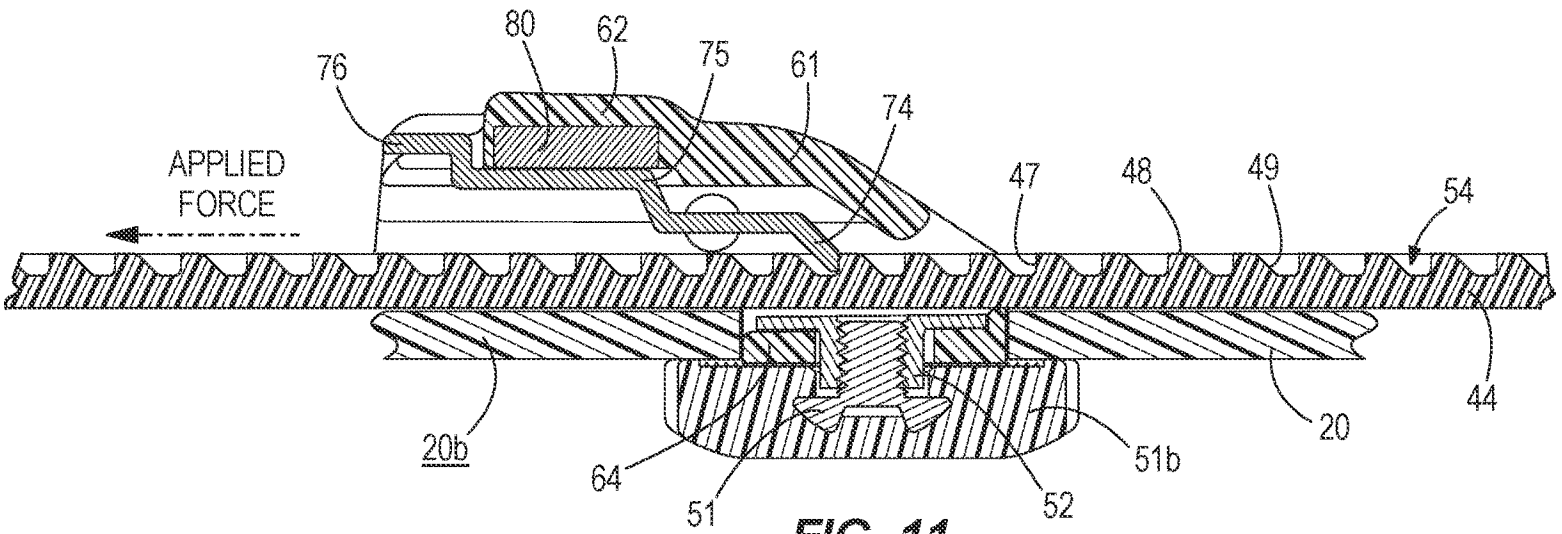
FIG. 11 is a partial cross-sectional view of the chin strap system, showing the system resisting movement of the strap.
Figure 12:
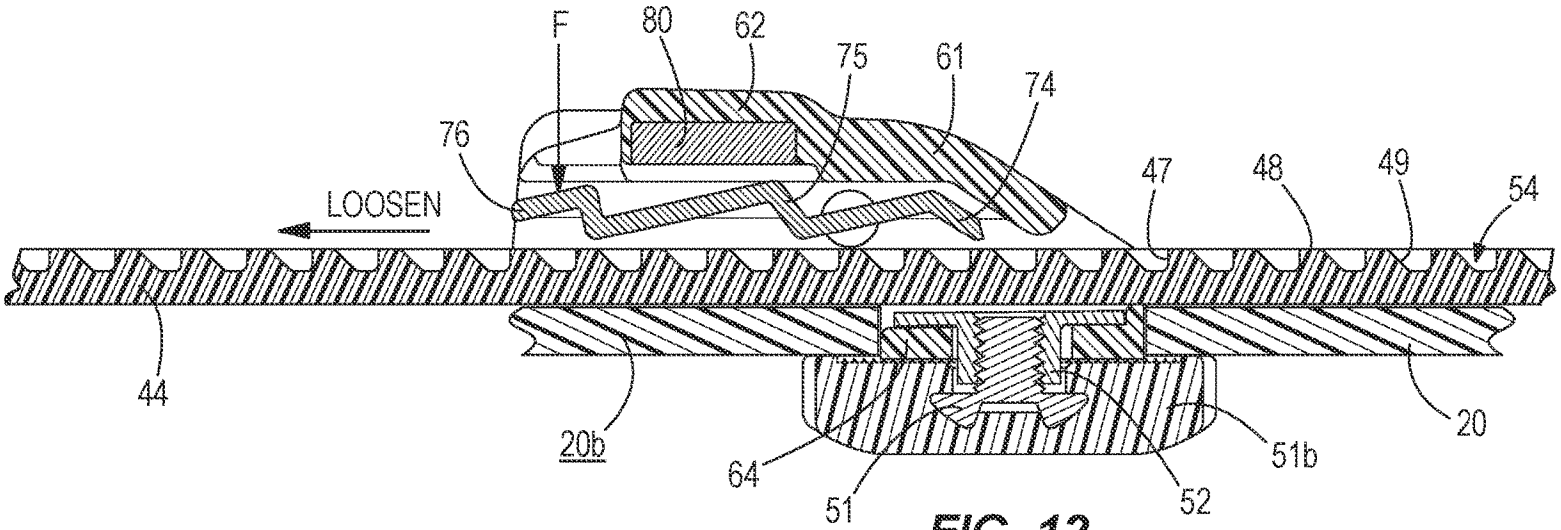
FIG. 12 is a partial cross-sectional view of the chin strap system, showing application of an actuation force F to the system that allows for movement of the strap that results in the system being loosened.

As best shown in FIGS. 4-12, the adjustable connector 50 includes an engaging element, such as lever 70 positioned within the central opening 67 and operably connected to the main body 60. Alternatively, the engaging element is configured as a depressible pin or movable wedge that rides along the engaging elements 45 of the strap member 44. The lever 70 engages an extent of the strap member 44 and also functions as an actuator to allow the player to selectively adjust the relative position of the strap member 44 (and the chin cup 42) with respect to the connector 50, which improves the fit and feel of the chin strap assembly 40 and the helmet 10. The lever 70 includes opposed extensions 72 (e.g., pins) that are received by an opening 63*a* in the side walls 63, wherein the lever 70 is axially pivotable about the extensions 72 when the player P, or coach or training staff member depresses an exposed front segment 76 of the engagement lever 70. As shown in FIGS. 4, 5 and 9-12, the engagement lever 70 also has an intermediate segment 75 and a rear segment 74 that engages an extent of the strap member 44. These segments 74-76 include intervening angles that provide the lever 70 with a "stepped" or "staggered" configuration when viewed from the side. Referring to FIG. 12, when the player or training staff member exerts an inwardly directed actuation force F and depresses the exposed front lever segment 76, the rear segment 74 pivots away from the strap member 44, thereby freeing the strap member 44 to be displaced through the central opening 67 in either lateral direction relative to the connector 50.

The adjustable connector 50 is configured to keep the engagement lever 70 engaged with the strap member 44 in a default position by including a biasing member 80, such as a magnet or a spring. Preferably, the biasing member 80 is located between the engagement lever 70 and an inner wall of the main body 60. The biasing member 80 shown in the Figures is a magnet that is positioned between an upper surface of the engagement lever 70, preferably the intermediate segment 75, and the inner surface of the top body wall 62. In this positional relationship, the biasing member 80 exerts an attractive force on the engagement lever 70, which maintains the proper operating positions of the lever 70. When the player, coach or training staff member applies the actuation force F to depress the exposed lever segment 76, the resulting depression overcomes the biasing member's force and causes the engagement lever 70 to pivot about its side extensions 72. This pivoting action causes the front segment 76 to move towards the strap member 44 and the rear segment 74 to disengage securing elements 45 of the strap member 44 to allow for sliding movement of the strap member 44, as discussed below.

The strap member 44 includes opposed side rails 43 and a plurality of securing elements 45 (e.g., an array of holes, teeth, ridges or bumps) that the rear segment 74 engages to secure the strap member 44 in a fixed position within the central opening 67 and relative to the connector 50. The side rails 43 extend along the length of the strap member 44 and the securing elements 45 are positioned between the side rails 43. The inclusion of side rails 43 increases the structural rigidity and durability of the strap member 44, as well as helping to maintain the engagement between the rear segment 74 and the securing elements 45. A terminal end of the strap member 44 includes a tab 46 that is configured to be grasped by the player P, coach, or member of the training staff to facilitate actuation of the strap member 44. In one embodiment, the tab 46 is detachable from the strap member 44 to allow for adjustment of the member's length. In one embodiment, the strap member 44 is formed from a material with a higher stiffness than conventional chin strap members. For example, the strap member 44 is molded from plastic, specifically urethane, nylon, polypropylene or a blend of these materials.

In one embodiment, the securing elements are ridges 45 that extend between the side rails 43 and that include a vertical or linear surface 47, a substantially flat top wall 48 and an angled surface 49. A recess 54 is defined between two adjacent ridges 45 and as a result, the strap member 44 includes numerous recesses 54. The ridges 45 can extend continuously between the side rails 43 or be segmented to provide a gap. Referring to FIG. 10, the recess 54 is positioned between the angled surface 49 of one ridge 45 and the vertical surface 47 of an adjacent element 45. The angled surface 49 provides a camming surface allowing the rear segment 74 to slide up the angled surface 49 and over the top wall 48 and drop into engagement with the adjacent ridge 45 when the strap member 44 is pulled in a first direction, without depressing the exposed lever segment 76. Referring to FIG. 11, when the strap member 44 is pulled in a second (opposite) direction, the rear segment 74 engages the vertical surface 47 of the ridge 45 and this engagement prevents displacement of the strap member 44 in the second direction, without depressing the exposed lever segment 76. Thus, the interaction between the lever 70 and the strap member 44, namely the ridges 45 and recesses 54 provides a ratcheting operation for the connector 50 and the strap member 44. The first direction is associated with tightening the chin strap assembly 40 relative to the helmet 10 and the player P, and the second direction is associated with an attempt to loosen the chin strap assembly 40 relative to the helmet 10 and the player P. It is understood that the extent of first direction movement that results in tightening the chin strap assembly 40 depends upon the player's anatomical features, including the player's jaw configuration.

Referring to FIG. 12, when the player P applies the actuation force F to depress the exposed lever segment 76, the rear lever segment 74 pivots away from the strap member 44 such that the rear segment 74 disengages the ridges 45 whereby the strap member 44 can be displaced in either the first direction or the second direction. Referring to FIG. 12, the actuation force F applied by the player to depress the exposed segment 76 is applied substantially perpendicular to the connector 50 and the helmet shell 20. When the rear segment 74 is sufficiently disengaged, the rear segment 74 "clears" the ridges 45 to allow for longitudinal displacement of the strap member 44 in the first or second directions. When the exposed front lever segment 76 is depressed and the rear lever segment 74 disengages the strap member 44, the strap member 44 can be displaced freely within the central opening 67 and the adjustable connector 50. Therefore, upon application of the actuation force F, the adjustable chin strap system 15 enables the player P to precisely adjust the position and fit of the chin strap assembly 40 which increases the comfort and wearability of the helmet 10.

Figure 2:
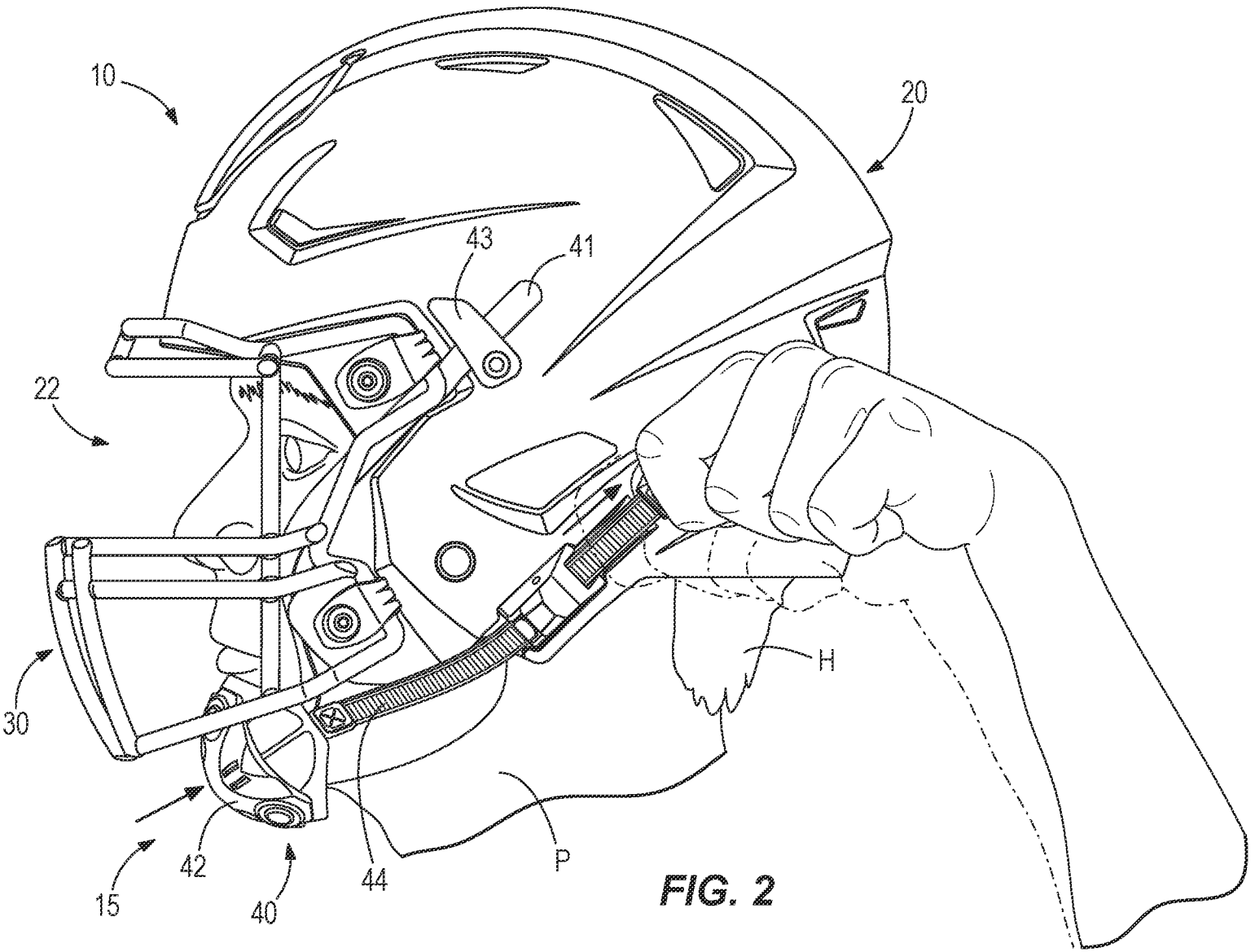
FIG. 2 is a side view of the helmet and adjustable chin strap system, showing the helmet on the wearer's head and the chin strap in a second, tightened position.
Figure 3:
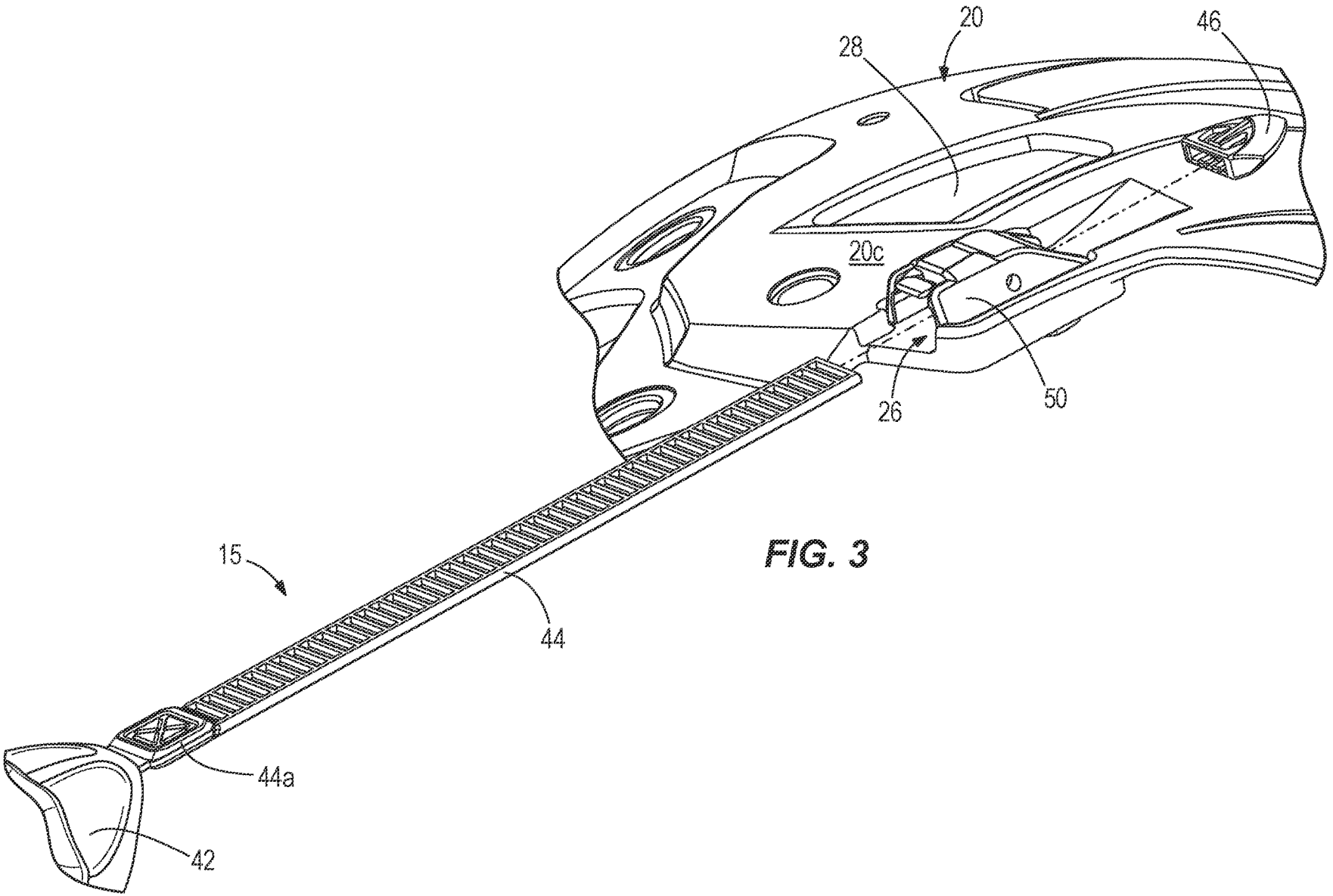
FIG. 3 is a partial exploded view of the helmet and adjustable chin strap system, showing the chin strap disengaged from the helmet.
Figure 4:
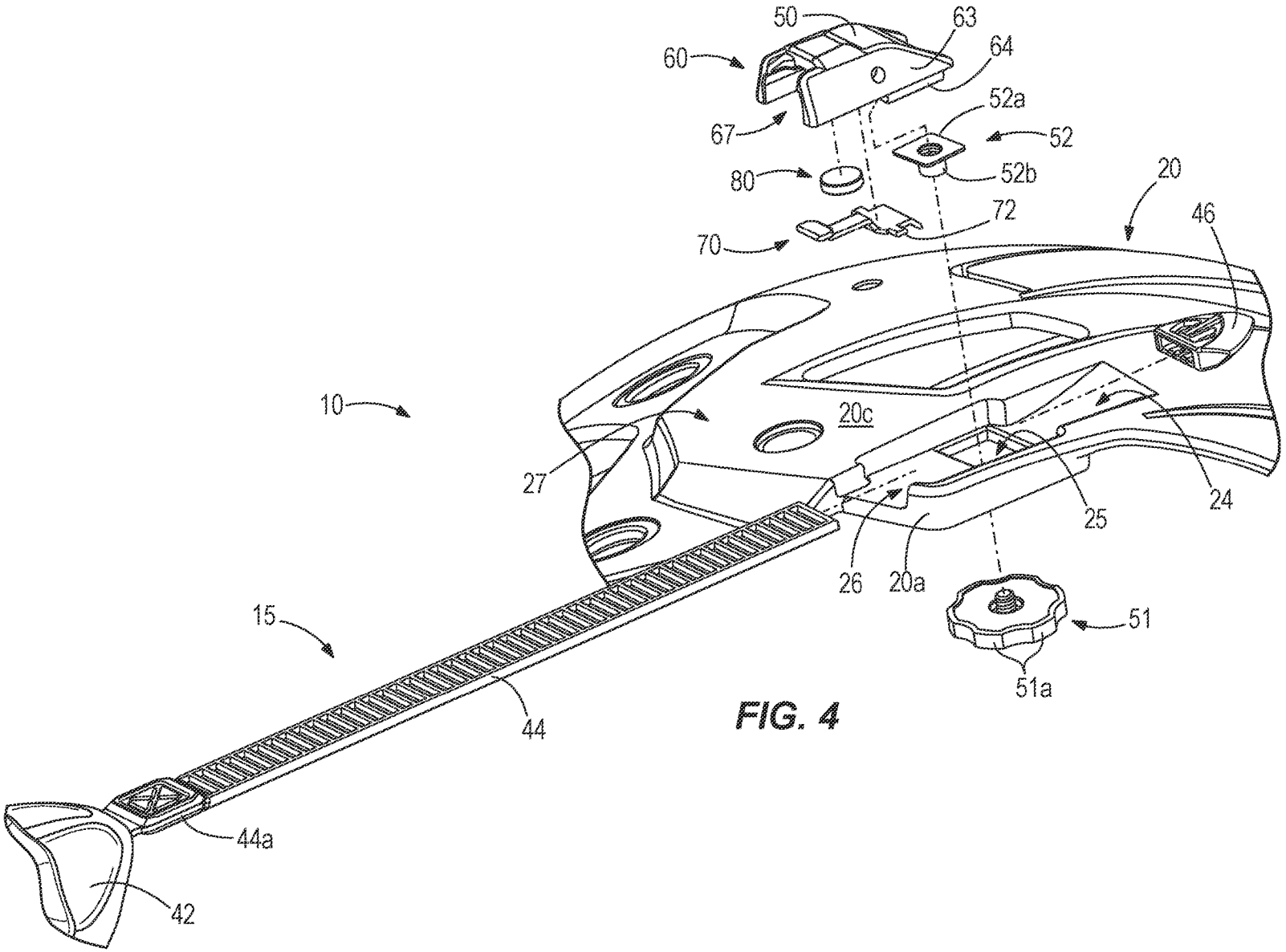
FIG. 4 is a partial exploded view of the helmet and adjustable chin strap system, showing the chin strap and connector bracket disengaged from the helmet.
Figure 5:
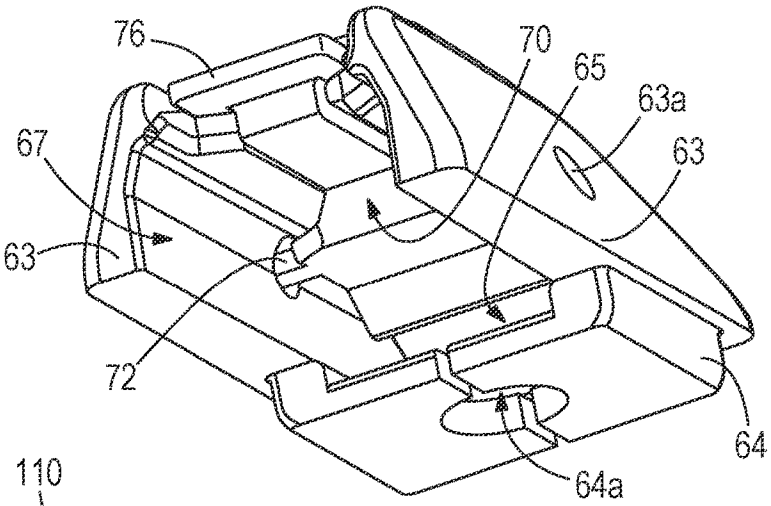
FIG. 5 is a bottom perspective view of the connector bracket of the adjustable chin strap system.

Once the helmet 10 is placed upon the player's head in the initial, loose position of FIG. 1, the player P, with one of his hands, tightens the chin strap assembly 40 to the desired level by pulling on the tab 46 and/or pushing the strap member 44 further into the adjustable connector 50. As shown in FIGS. 2 and 10, the tab 46 is directed towards the rear portion of the helmet 10 and the connector 50. The tightening process can occur in one instance or a series of adjustments to attain the desired fit of the chin strap assembly 40. The player P does not need to depress the exposed lever segment 76 while tightening the strap member 44. In addition, the ratcheting operation provided by the connector 50 and the strap member 44, including the interaction between the lever 70 and the ridges 45, occurs when the strap member is being tightened but not loosened. In the embodiment of the Figures, the ratcheting operation provides an audible sound to the player P that can help him/her ascertain the extent of tightening of the chin strap assembly 40.

To loosen the chin strap assembly 40, the player P applies the actuation force F to depress the exposed lever segment 76 which disengages the rear segment 74 from the ridges 45 and then the player P pushes and/or pulls the strap member 44 towards the front shell edge 20*a* and away from the connector 50. In other words, during the loosening process the strap member 44 is directed towards the face guard 30 and away from the connector 50. In the embodiment of the Figures, the player P applies the actuation force F and depresses the exposed lever segment 76 during the entirety of the loosening process and then releases the lever segment 76 when the desired amount of loosening of the chin strap 40 is attainted. The steps of both depressing the exposed lever segment 76 and pulling the strap member 44 may be rapidly performed with a single hand of the player P. If the chin strap assembly 40 is loosened too much and needs to be tightened, the player P merely pulls and/or pushes the strap member 44 further into the adjustable connector 50. The player P can accomplish this step without having to engage the adjustable connector 50, including depressing the exposed lever segment 76. Thus, the player P can rapidly loosen and tighten the chin strap assembly 40 with one hand, obviating the need for the player P to return to the sideline to get assistance from a training staff member, coach or another player.

To remove the helmet 10, the player P loosens the chin strap assembly 40 to allow the chin cup member 42 to clear the player's chin when the helmet 10 is elevated from the player's head H. To loosen the chin strap assembly 40, the player P applies the actuation force F to depresses the exposed lever segment 76 and then pulls and/or pushes the strap member 44 such that the strap member 44 is displaced towards the front shell edge 20*a* and away from the main body 60. The strap member 44 does not exit the central opening 67 and disengage the connector 50 because the strap tab 46 engages the rear extent of at least one side wall 63 to prevent disengagement. Once the chin strap assembly 40 is sufficiently loosened, the player P can remove the helmet 10 from his/her head. The player P can complete these actions with one hand, and does not require assistance from another player, coach or training staff member. When the player P returns to the field of play and needs to wear the helmet 10, the player P simply repeats the steps above. The functionality of the helmet 10 and adjustable chin system 15 is not provided by conventional helmets and chin strap assemblies.

In FIGS. 1-12, the system 15 is configured in an external connection arrangement with the helmet 10. In another embodiment, the adjustable chin strap system is configured for an internal connection arrangement wherein adjustable connector bracket is affixed to an internal surface of the helmet 10. As a result, the lower strap member 44 is received and secured by the connector bracket within the helmet 10. The connector bracket includes an engaging element, such as lever 70, that is externally oriented relative to the helmet 10 such that it can be actuated by the player P in the manner described above. For example, the engaging element and the top wall of the housing of the bracket are substantially flush with the outer shell surface 20*c* of the helmet 10 and the bottom wall of the bracket housing is recessed from the inner shell surface 20*b* of the helmet 10. During use and operation of the internalized system, the lower strap member 44 is adjustable within the shell 20 whereby an extent of the strap member 44 slides along the inner shell surface 20*b* when it is displaced by the player P, coach or member of the training staff.

While the specific embodiments have been illustrated and described, numerous modifications come to mind without significantly departing from the spirit of the invention, and the scope of protection is only limited by the scope of the accompanying Claims. While the specific embodiments have been illustrated and described, numerous modifications come to mind without significantly departing from the spirit of the invention, and the scope of protection is only limited by the scope of the accompanying Claims.

What is claimed is:

1. A chin strap assembly configured for use with a protective sports helmet to be worn by a player, the chin strap assembly comprising:

a chin cup having an outer layer and a padding layer, and wherein said chin cup is designed to overly a player's chin when the chin strap assembly is worn by the player;

an upper elongated strap operably coupled to the chin cup; and a lower elongated strap operably coupled to the chin cup and configured to: (i) slide in a first direction corresponding to tightening of the strap, and (ii) not slide in a second direction corresponding to loosening of the strap.

2. The chin strap assembly of claim 1, further comprising an adjustable connector having:

a housing with an arrangement of a top wall, a bottom wall, opposed side walls, and a strap opening, and wherein the lower elongated strap extends through the strap opening; and a movable engaging element configured to interact with an interaction portion of the lower elongated strap.

3. The chin strap assembly of claim 2, wherein a biasing member associated with the adjustable connector exerts a force on the movable engaging element, and whereby said force causes an extent of said movable engaging element to interact with said interaction portion of the lower elongated strap.

4. The chin strap assembly of claim 3, wherein said interaction between the extent of said movable engaging element and said interaction portion of the lower elongated strap prevents said lower elongated strap from moving in a loosening direction that loosens the chin strap assembly and allows the chin cup to disengage from the player's chin.

5. The chin strap assembly of claim 4, wherein, when a sufficient actuation force is applied on the movable engaging element to overcome the force exerted by the biasing member, the extent of said movable engaging element stops engaging said interaction portion of the lower elongated strap.

6. The chin strap assembly of claim 5, wherein, when the extent of said movable engaging element stops engaging said interaction portion of the lower elongated strap, said lower elongated strap can move in the loosening direction that allows the chin cup to disengage from the player's chin.

7. The chin strap assembly of claim 3, wherein said interaction between the movable engaging element and the portion of the lower elongated strap does not prevent said lower elongated strap from moving in a tightening direction that allows the chin cup to further engage the player's chin.

8. The chin strap assembly of claim 2, wherein the bottom wall is configured to reside in a securement opening formed in a shell of the protective sport helmet.

9. The chin strap assembly of claim 1, wherein the lower elongated strap does not include securement elements along an extent of its length.

10. The chin strap assembly of claim 2, wherein the lower elongated strap includes an enlarged tab provides the second end segment with a set of dimensions that are greater than a set of dimensions of said strap opening whereby the lower elongated strap is prevented from being disengaged from the adjustable connector.

11. The chin strap assembly of claim 1, wherein an extent of the lower elongated strap includes a plurality of securing elements.

12. The chin strap assembly of claim 11, wherein said plurality of securing elements are ridges formed in an outer surface of the lower elongated strap.

13. A connector assembly for use with a chin strap assembly configured for use with a protective sports helmet to be worn by a player, the connector assembly comprising:

a connector housing that is configured to be removably coupled to the protective sports helmet, wherein the connector includes an engaging element and a biasing member, the engaging element having (i) an inner segment, and (ii) a depressible outer segment that is accessible through an opening formed in an upper portion of the connector housing and that receives an actuation force applied by a player; and wherein said biasing member resides within the connector housing and exerts a biasing force on the engaging element, and whereby said biasing force causes the outer segment of the engaging element to move away from a lowermost extent of the connector housing when a player removes the actuation force from the outer segment of the engaging element.

14. The connector assembly for use with a chin strap assembly of claim 13, wherein said biasing force exerted by the biasing member on the engaging element causes the inner segment of the engaging element to be oriented towards a portion of a lower elongated strap of the chin strap assembly to prevent said lower elongated strap from moving in a loosening direction.

15. The connector assembly for use with a chin strap assembly of claim 13, wherein, when a sufficient actuation force is applied to the outer segment of the engaging element to overcome the force exerted by the biasing member, the inner segment of said engaging element stops engaging with a portion of a lower elongated strap of the chin strap assembly.

16. The connector assembly for use with a chin strap assembly of claim 15, wherein, when the inner segment of said engaging element stops engaging with the portion of the lower elongated strap, the lower elongated strap can move in a loosening direction that allows a chin cup of the chin strap assembly to disengage from the player's chin.

17. The connector assembly for use with a chin strap assembly of claim 13, further comprising a lower elongated strap that includes an enlarged tab that is configured to be grasped by a player to facilitate actuation of the lower elongated strap with the connector.

18. The connector assembly for use with a chin strap assembly of claim 13, wherein the biasing member is one of a magnet and a spring.

19. The connector assembly for use with a chin strap assembly of claim 13, wherein the housing includes a lower mating portion that depends from housing, wherein the mating portion is configured to be received within a cavity of the protective sports helmet.

20. The connector assembly for use with a chin strap assembly of claim 19, wherein the lower mating portion includes an aperture that receives a fastener that extends through the protective sports helmet to couple the connector to the protective sports helmet.

* * * * *